United States Patent [19]

Scholpp

[11] Patent Number: 4,840,044

[45] Date of Patent: Jun. 20, 1989

[54] ARTICULATED WRISTLET

[75] Inventor: Werner Scholpp, Oberriexingen, Fed. Rep. of Germany

[73] Assignee: Montres Rado S.A., Lengnau, Switzerland

[21] Appl. No.: 151,681

[22] Filed: Feb. 3, 1988

[30] Foreign Application Priority Data

Feb. 5, 1987 [FR] France ..... 87 01512

[51] Int. Cl.[4] ..... A44C 5/02

[52] U.S. Cl. ..... 63/4; 63/3; 59/80

[58] Field of Search ..... 63/4, 3, 9; 24/68 J, 24/265 B, 265 H, 265 R, 265 WS; 224/178, 179; 59/80, 82

[56] References Cited

U.S. PATENT DOCUMENTS

| | | | |
|---|---|---|---|
| 290,643 | 12/1883 | Joyce | 59/80 |
| 4,706,857 | 11/1987 | Aellen et al. | 63/3 X |

FOREIGN PATENT DOCUMENTS

| | | | |
|---|---|---|---|
| 0030705 | 6/1981 | European Pat. Off. . | |
| 2400475 | 5/1975 | Fed. Rep. of Germany | 59/82 |
| 1264684 | 5/1961 | France | 59/80 |
| 91828 | 7/1968 | France . | |
| 2567728 | 1/1986 | France . | |
| 558176 | 2/1957 | Italy | 59/80 |
| 604594 | 9/1978 | Switzerland . | |
| 262375 | 1/1927 | United Kingdom . | |
| 983420 | 2/1965 | United Kingdom . | |

*Primary Examiner*—Kenneth J. Dorner
*Assistant Examiner*—Laurie K. Cranmer
*Attorney, Agent, or Firm*—Griffin, Branigan & Butler

[57] ABSTRACT

An articulated wristlet has a plurality of decorative elements, an equal number of elements articulated by hinges capable of being unhooked and sliding type fittings. Adjacent lateral faces of two juxtaposed decorative elements hold the decorative elements to each other when the wristlet is worn normally. The lateral faces are shaped to permit the releasing of two adjacent decorative elements when the wristlet is folded beyond a predetermined angle, this releasing permitting the removal of one decorative element of the wristlet and then the unhooking of the corresponding linking element.

The arrangement permits adjustment in the length of the wristlet without the use of tools.

7 Claims, 4 Drawing Sheets

ARTICULATED WRISTLET

FIELD OF THE INVENTION

The invention relates to an articulated wristlet having a plurality of decorative elements arranged side by side along a longitudinal axis, a flexible inner core, assembly means fixing each decorative element to the inner core said means having a series of sliding type fittings only permitting movement of the decorative element in relation to said inner core along a longitudinal direction and locking means holding the decorative elements together when the wristlet is worn normally and having lateral forces adjacent to each other on two juxtaposed decorative elements.

DESCRIPTION OF THE PRIOR ART

A wristlet corresponding to the generic definition set out above is described in Patent No. CH-A-604 594. Each of the visible links or decorative elements of this wristlet has locking means consisting of two semi-cylindrical surfaces of the same radius, one of which is concave and the other convex. This wristlet also has a flexible inner core and an assembly of the sliding type making it possible to associate each decorative element to the inner core. The inner core comprises a series of linking elements having parts that are folded in the shape of hooks and corresponding openings to lock two decorative elements in such a way that the concave part of one rests on the convex part of the other, whilst still being able to pivot.

BRIEF SUMMARY OF THE INVENTION

In common with the wristlet of the present invention which will be described below, the wristlet of the above-cited patent has an inner core which unaided bears the mechanical tractive force exerted on said wristlet. The core is covered with various decorative elements which are not subjected to any mechanical stress. If the wristlet described in the reference is of simple assembly where the decorative links are not joined by screws or pins and therefore do not involve the use of special tools, there then arises the question of adjusting the length of the wristlet or modifying its aesthetic appearance because, in the construction devised, there is no angular position at which a decorative element can be removed from the flexible inner core. This would have to be done starting from a special linking element which is not described and which would inevitably involve the use of tools.

To overcome these above mentioned disadvantages and to provide a wristlet at least one link of which can be changed or else added or removed without the use of tools regardless of its position in the chain of which it forms a part, the wristlet of the present invention is notable for the fact that, apart from the characteristics set out in the first paragraph above, the said lateral faces are so formed as to permit the releasing of two adjacent decorative elements when the wristlet is folded beyond a predetermined angle, said releasing permitting the removal of one decorative element of the wristlet by sliding said decorative element along said sliding type fittings.

BRIEF DESCRIPTION OF THE DRAWINGS

The invention may be better understood from the following description, said description being illustrated by way of example by the drawings in which.

DETAILED DESCRIPTION OF THE DRAWINGS

Figure 1A:
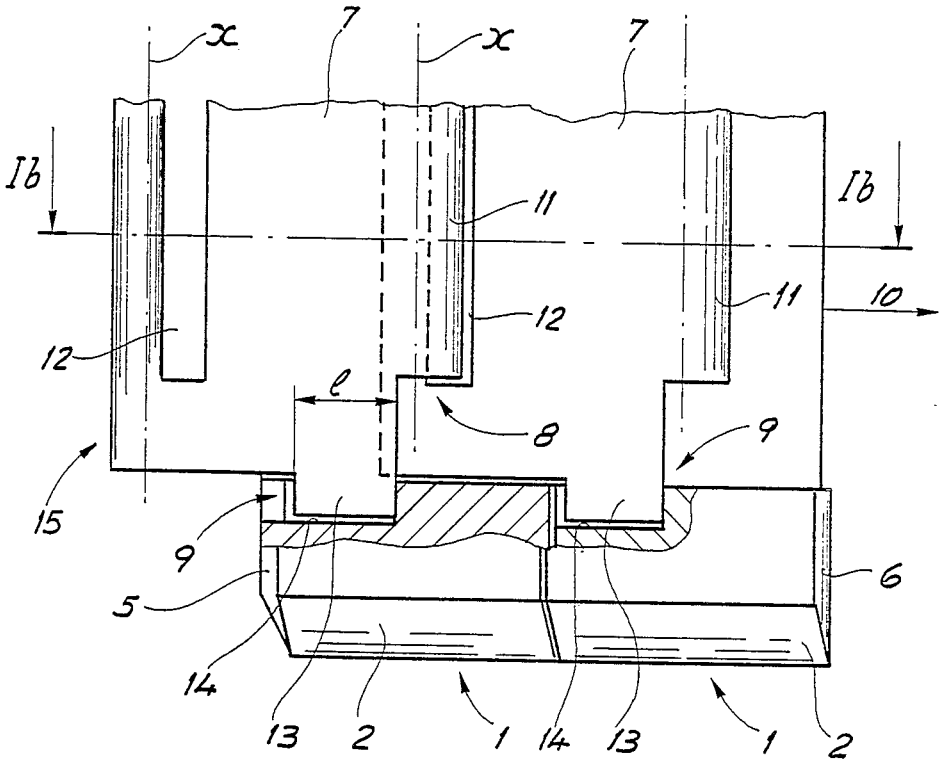
FIG. 1*a* is a partial view of the underside of a wristlet according to a preferred embodiment of the invention, said view being restricted to two links of said wristlet.
Figure 1B:
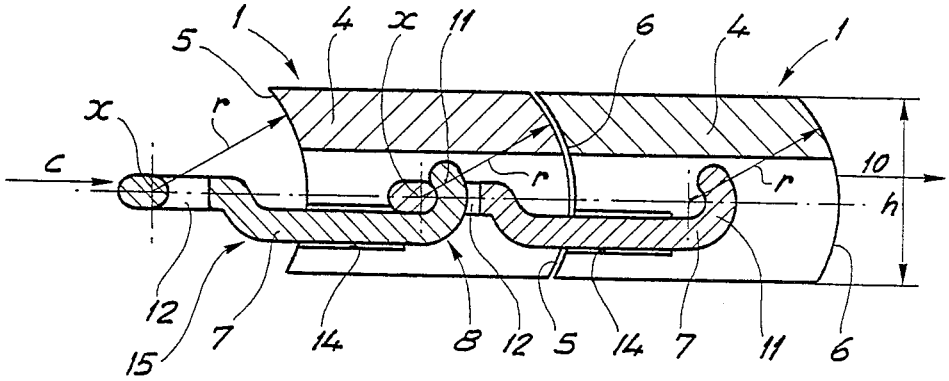
FIG. 1*b* is a section along the line Ib—Ib of FIG. 1*a*.
Figure 1C:
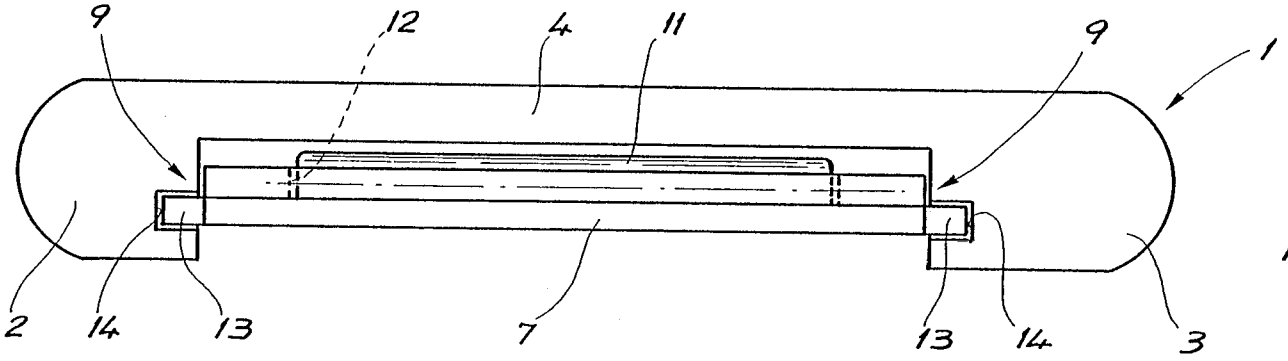
FIG. 1*c* is a view along the arrow C of FIG. 1*b*.

FIGS. 1*a* and 1*b* are drawings showing a view from below and in section respectively of the wristlet according to a preferred embodiment of the invention, only two links being shown. FIG. 1*c* is a view of the end of the wristlet along the arrow C shown in FIG. 1*b*. The wristlet has a plurality of decorative elements which are arranged side by side. The decorative elements 1 are situated transversely in relation to a longitudinal axis of the wristlet. The wristlet also has a flexible inner core 15 composed of linking elements 7 articulated with respect to each other by means of hinges 8 along an axis of articulation x. A linking element is attached to each decorative element 1 by assembly means 9 comprising of sliding type fittings which, as is clearly shown in FIG. 1*a* , only permit movement of the decorative element 1 in relation to the corresponding linking element 7 along a longitudinal direction shown by the arrow 10. When the wristlet is worn normally, the adjacent lateral faces 5 and 6 of two decorative elements 1 are located at least partially facing each other and thus prevent these elements from escaping from the corresponding linking elements 7. These lateral faces thus constitute means for locking one decorative element to the other.

More particularly, in the embodiment shown in the drawings, the decorative elements 1 have the appearance of stirrups or U-shaped elements each provided with two depending legs or branches 2 and 3 joined by a solid part 4 which forms the upper visible part of the wristlet. Similarly, the lateral faces 5 and 6 of each decorative element have a cylindrical convex portion 5 and a cylindrical concave portion 6 of substantially identical radii of curvature r. Thus, when the decorative elements 1 are mounted on the linking elements 7, they can move angularly in relation to one another by sliding said cylindrical portions against each other.

Figure 2:
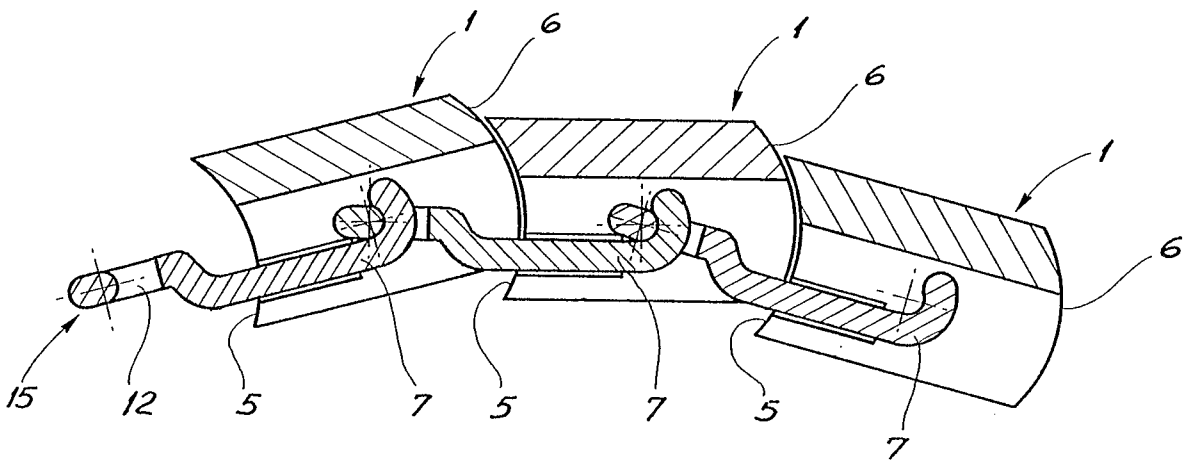
FIG. 2 is a sectional view of part of the wristlet when this is worn normally on the wrist.

When the wristlet is worn normally, in other words, when its curve takes up the curvature of the wrist, the cylindrical portions 5 and 6 at least partially cover one another as shown in FIG. 2. Because the decorative elements 1 are fixed to the linking elements 7 by assembly means 9, detachment of these decorative elements from the chain is prevented.

Still referring to the special embodiment shown in the drawings and as set out in FIGS. 1*a* and 1*b*, the axis of articulation x of one linking element 7 to the adjacent element coincides with the axis of the concave cylindrical portion 6 of a decorative element.

The linking element 7 is in the form of a substantially rectangular plate terminated by a hook 11 situated on one of its longer sides and by an opening 12 situated on the opposite longer side. The hook 11 and opening 12 together form the hinge 8. The shorter sides of the plate each have a guide member adapted to engage with a blind channel 14 provided in each of the branches 2 and 3 of the stirrup. As shown in FIG. 1*a* the right decorative element 1 can therefore only be disengaged from the linking element 7 in the direction of the arrow 10. Similarly, restricting the length of the channel 14 fixes the element 7 exactly in position in relation to the element 1.

In general terms, the wristlet of the invention has decorative elements 1, the lateral faces 5 and 6 of which are shaped so as to permit the releasing of two decorative elements when the wristlet is folded by more than a predetermined angle $\alpha$, permitting the removal of at least one decorative element of the wristlet and the insertion in place thereof of another decorative element having, for example, a different aesthetic appearance. Thus, without need for the use of any tool whatsoever, it is possible for the seller or even the purchaser of the wristlet to modify as desired the composition of the object if they have two or a plurality of different decorative elements. One can therefore conceive a wristlet all in gold or all in steel or also presenting a regular alternative arrangement of gold and steel elements. One can also conceive elements on which would be positioned, for example by means of setting, one or several precious stones.

As has already been stated above, the inner core provides on its own the mechanical tractive effort exerted on the wristlet. It is therefore possible to use decorative elements made from hard and brittle materials and which would not withstand such a strain if they were directly attached one to another. These could be synthetic or natural sapphire, polycrystalline ceramic materials or also hard metals sintered at more than 1000° C. Thus, for example, the wristlet of the invention could have a large variety of decorative elements made out of these specific materials taken alone or in combination.

In the specific embodiment having lateral cylindrical faces as shown in the drawings, the angle $\alpha$ as from which the element 1 could be removed from the chain will depend on the radius of curvature r and on the total thickness h of the decorative element 1 taken in combination. This is illustrated in FIGS. 3*a* and 3*b* which are geometrical drawings of two situations of different choices for the parameters r and h given above.

Figure 3A:
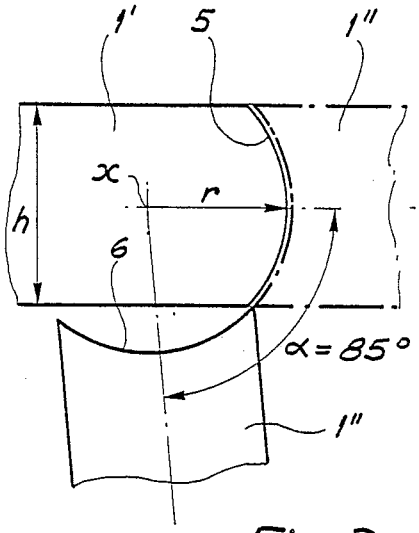
FIGS. 3*a* and 3*b* are geometric drawings illustrating the rotation of one element of the wristlet in relation to an adjacent element in two different configurations.

FIG. 3*a* shows two juxtaposed decorative elements 1' and 1''. To permit disengagement of the element 1' it would be necessary to bend the element 1'' in relation to the element 1' to an angle $\alpha=85°$. If the radius of curvature of the elements 1' and 1'' is designated r and the total thickness of the same elements is designated h, and if one assumes that the axis of articulation x of one element on the other is identical with the axis of the cylindrical portion 5 of the radius r, and if the axis x is situated in the middle of the thickness h it is possible to calculate that r must be equal to or greater than $h\sqrt{2}/2$ if one wishes to be able to disengage the element 1' completely. Thus, for a decorative element having a thickness h of 3.2 mm the radius of curvature r should be equal to or greater than 2.25 mm.

Figure 3B:
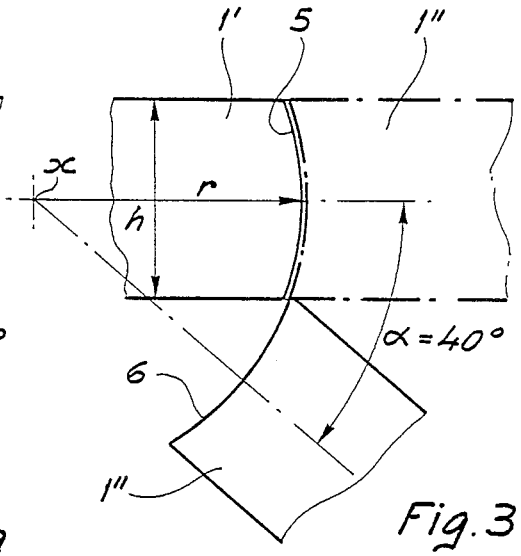

FIG. 3*b* shows decorative elements 1' and 1'' of the same thickness as that chosen for FIG. 3*a*. Here, the radius of curvature r has been increased. It may be seen that disengagement of the element 1' is possible when the angle $\alpha$ is only 40°.

Referring once more to FIGS. 1*a* to 1*c*, it can be seen that the plate forming the linking element 7 has a single hook 11 which is bent over and made in one piece with the plate. This hook extends along more than half the length of the long side of said plate. Similarly, the opening 12, the length of which is adapted to the hook 11, is stamped directly out of the plate 7. The guide members 13 are also cut out of the extension in the plane of the plate. Their widths 1 are chosen so as to be sufficiently large to avoid any rotation of the plate in relation to the decorative element and to the channels 14 in which they slide. Thus, the only way in which the decorative element 1 can move in relation to the corresponding plate 7 is along a longitudinal direction 10, as already mentioned above.

FIG. 1*b* also shows that the axis of articulation x of one plate with respect to another is situated in a plane different from the plane of the plate per se, the latter being situated in the same plane as the guide members 13. It is clear that one could have a situation in which the axis x would be situated in the same plane as the plane of the plate per se without departing from the object of the present invention.

Figure 4:
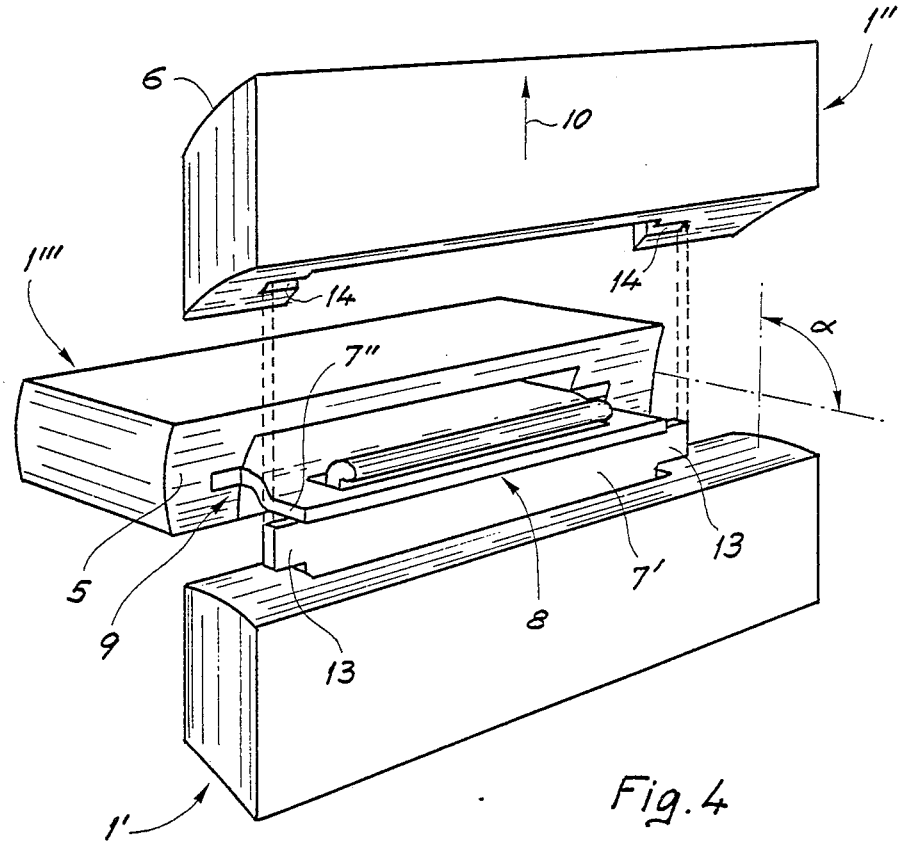
FIG. 4 is a perspective view of the wristlet of FIGS. 1*a* and 1*b*, showing how one link of the wristlet can be removed

FIG. 4 is a perspective view which shows the procedure for removing a link of the wristlet. Here, the wristlet is limited to three decorative elements 1', 1'' and 1'''. To disengage the element 1'', the element 1''' is bent through an angle $\alpha$ towards the back of the figure. The concave face 6 of the element 1'' is then no longer engaged in relation to the convex face 5 of the element 1''' and the element 1'' can be slid out of the linking element 7' in the direction of the arrow 10 by sliding the channels 14 out of the guide members 13. It is then possible to replace the element 1'' by another element, for example of different colour. FIG. 4 also shows that one can unhook the hinge 8 by aligning the element 1' with respect to the element 1''' which will make it possible to separate the linking elements 7' and 7'' from one another and to thereby lengthen or shorten the wristlet at will without the use of tools. This operation, termed length adjustment, will now be explained with the aid of FIG. s 5*a* to 5*m*.

Figure 5:
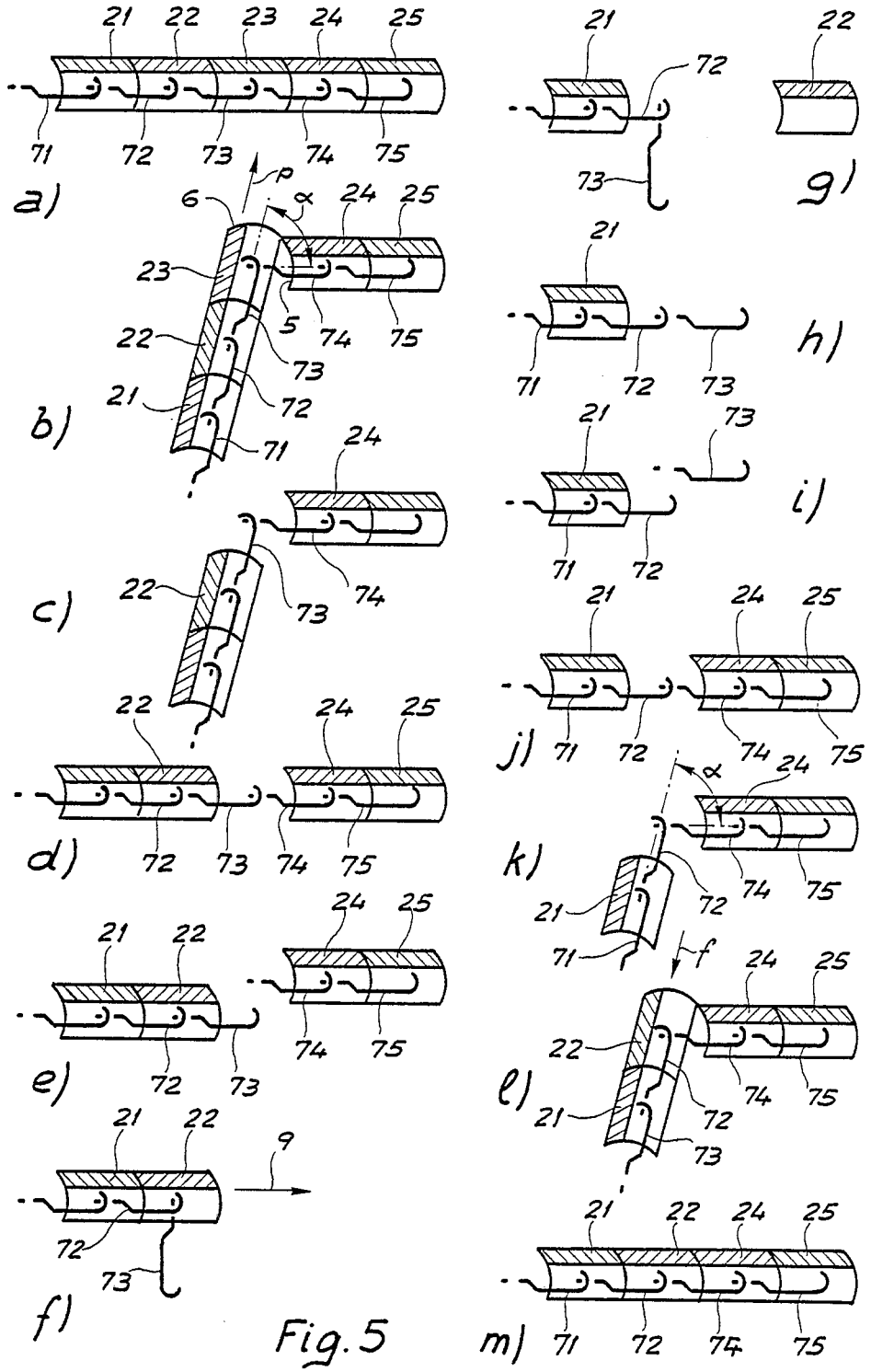
FIGS. 5*a* to 5*m* show schematically the operations to be carried out in order to remove one link of the wristlet of the invention.

FIGS. 5*a* to 5*m* show schematically the operations to be carried out in order to shorten the wristlet by one link. FIG. 5*a* shows a sequence of five decorative elements 21 to 25 held together by five corresponding linking elements 71 to 75. The objective is to shorten the wristlet by removal of the elements 23 and 73. To do this, the wristlet is folded beyond the predetermined angle $\alpha$ by pivoting the element 73 in relation to the element 74 (FIG. 5*b*). The lateral faces 5 and 6 of the elements 24 and 23 are then disengaged from one another, making it possible to remove the decorative element 23 in the direction of the arrow p, giving the result shown in FIG. 5*c*. The remaining links are then aligned as shown in FIG. 5*d*, making it possible to disengage the linking elements 73 and 74 from one another (FIG. 5e). Elements 24, 74 and 25, 75 are set aside. The linking element 74 is then rotated towards the bottom of the figure, making it possible to remove the decorative element 22 in the direction of the arrow q (FIG. 5*f*).

Element 22 is set aside (FIG. 5*g*). Element 73 is returned to the horizontal (FIG. 5*h*), making it possible to unhook it from the element 72 (FIG. 5i). The element 72 is joined to the group 74, 24, 75, 25 which was set aside (FIG. 5*j*). The linking elements 72 and 74 are bent about an angle $\alpha$ (FIG. 5k) which makes it possible to slide the decorative element 72 along the direction of the arrow f (FIG. 51). Finally, the wristlet which has been relieved of one decorative element 23 and of its corresponding linking element 73 is straightened (FIG. 5*m*). The shortening process just given as an example makes it clear that any link in the chain can be removed. However, if the wristlet is designed to carry a watch, the arrangement according to the invention could be limited to a few links located beside the watch case or the side of the clasp of the wristlet.

The embodiment described above emphasises the rounded lateral forces which overlap with each other when the wristlet is worn normally. It is, however, obvious that these lateral faces could have other shapes that do not lock as closely to one another as shown. These faces could, for example, be flat or be composed of two or a plurality of flat portions without diverging from the object of the invention, the essential feature residing in the fact that these faces are adapted to lock the decorative elements the one to the other when the wristlet is worn normally and to release at least one of these elements when the wristlet is folded beyond the predetermined angle $\alpha$.

Depending on the materials used for the elements making up the wristlet and the dimensional tolerances adopted when manufacturing it, there could be a risk of some of the decorative elements escaping from the linking elements holding them in position, at the wrong moment, when the wristlet was removed from the wrist. To avoid this, a suitable locking or press fit system for the decorative element on the linking element could by employed necessitating the exertion of a certain degree of force to remove the decorative element.

Generally speaking, the wristlet of the invention has a series of decorative elements fixed to a flexible inner core made all in one piece. In the preferred embodiment described above, this inner core is composed of the same number of linking elements and decorative elements, these linking elements being attached to one another in series by means of hinges. Nevertheless the invention is not limited to this single embodiment.

The inner core could, for example, be made from a single elongated flexible band of steel or rubber. Guide members 13 could project at regular intervals from this band along the direction of its width. In this case it is the flexibility of the band which would replace the hooked hinges described above.

The inner core could also be made of a single piece of rubber, inside which steel plates arranged transversely to the core could be retained firmly and projecting therefrom to form the guide members 13. One plate would be provided for each decorative element.

The two variants suggested above could be suitable in cases where the sole aim would be the aesthetic modification of the wristlet. The shortening could, however, be easily envisaged in the event of the inner core being of rubber. It would then be sufficient to cut a section of the core on the clasp or watch case side, to a length corresponding to one or several decorative elements.

I claim:

1. An articulated wristlet having a plurality of decorative elements, said elements being arranged side by side along a longitudinal axis, a flexible inner core, assembly means fixing said decorative elements to said inner core, said assembly means having a plurality of sliding type slide fittings, whereby the decorative elements are mounted on the slide fittings in a manner such that movement of the decorative elements is only permitted in a direction longitudinal to said wristlet, said assembly means comprising the engagement of guide members carried by said flexible inner core in channels carried by said decorative elements, each decorative element having a lateral face which covers at least partially the lateral face of an adjacent element in order to lock said elements between them when the wristlet is worn normally, said lateral faces being shaped in such a manner that they uncover one another when the wristlet is folded beyond a predetermined angle, thus permitting the releasing and the removal of any one decorative element located anywhere along the wristlet by sliding said one decorative element along the sliding type fitting on which it is mounted.

2. An articulated wristlet according to claim 1, wherein the decorative elements are made of a hard and brittle material.

3. An articulated wristlet having a plurality of decorative elements, said elements being arranged side by side along a longitudinal axis, a flexible inner core, assembly means fixing said decorative elements to said inner core, said assembly means having a plurality of sliding type slide fittings, whereby the decorative elements are mounted on the slide fittings in a manner such that movement of the decorative elements is only permitted in a direction longitudinal to said wristlet, each decorative element having a lateral face which covers at least partially the lateral face of an adjacent element in order to lock said elements between them when the wristlet is worn normally, said lateral faces being shaped in such a manner that they uncover one another when the wristlet is folded beyond a predetermined angle, thus permitting the releasing and the removal of any one decorative element located anywhere along the wristlet by sliding said one decorative element along the sliding type fitting on which it is mounted;

said flexible inner core having a plurality of linking elements, said linking elements being present in the same number as the number of decorative elements, said linking elements being further articulated to one another in series by means of hinges, said hinges being capable of being unhooked, said decorative elements and said linking elements being provided with said assembly means, said releasing permitting the removal of a decorative elements from the wristlet by sliding said decorative element along the corresponding assembly means, followed by the unhooking of said linking element.

4. An articulated wristlet according to claim 3, wherein the decorative elements have a cross section substantially in the form of an inverted U-shape with the depending legs of said U-shape extending parallel to the longitudinal axis of the wristlet, said lateral faces of each of said decorative elements having concave and convex arcuate portions of substantially identical radii of curvature (r), the axis (x) along which the linking element is articulated in relation to an adjacent linking element being positioned so as to substantially coincide with the axis of the concave arcuate portion of a decorative element, said radius of curvature and the total thickness (h) of each said decorative element being dimensioned in relation to one another in such a manner as to permit the folding of the wristlet beyond said predetermined angle.

5. An articulated wristlet according to claim 4, wherein each linking element has the shape of a substantially rectangular plate terminated by at least one hook situated on one of its long sides and by at least one opening situated on the opposite long side, said opening being adapted to receive the hook of the next linking element, the shorter sides of said plate each comprising a guide member adapted to engage in a blind channel provided in each of said depending legs of the decorative element, said guide members and channels forming said assembly means.

6. An articulated wristlet according to claim 5, wherein the plate and the hook are made in one piece and the hook extends along more than half of the length of the longer side of said plate, a stamped and elongated opening situated on the opposite longer side of the plate and two guide members extending in the plane of said plate.

7. An articulated wristlet according to claim 6, wherein the axis of articulation (x) of one plate with respect to another is disposed in a plane different from a plane containing said two guide members.

* * * * *